US010011918B2

(12) United States Patent
Changchien et al.

(10) Patent No.: US 10,011,918 B2
(45) Date of Patent: Jul. 3, 2018

(54) APPARATUS AND PROCESS OF ELECTRO-CHEMICAL PLATING

(71) Applicant: TAIWAN SEMICONDUCTOR MANUFACTURING CO., LTD., Hsinchu (TW)

(72) Inventors: Ying-Hsueh Changchien, Hsinchu (TW); Yu-Ming Lee, New Taipei (TW); Chi-Ming Yang, Hsinchu (TW)

(73) Assignee: TAIWAN SEMICONDUCTOR MANUFACTURING CO., LTD., Hsinchu (TW)

( * ) Notice: Subject to any disclaimer, the term of this patent is extended or adjusted under 35 U.S.C. 154(b) by 181 days.

(21) Appl. No.: 14/581,876

(22) Filed: Dec. 23, 2014

(65) Prior Publication Data

US 2016/0177467 A1 Jun. 23, 2016

(51) Int. Cl.

| | |
|---|---|
| ***C25D 5/00*** | (2006.01) |
| ***C25D 3/02*** | (2006.01) |
| ***C25D 21/06*** | (2006.01) |
| ***C25D 21/02*** | (2006.01) |
| ***C25D 21/18*** | (2006.01) |

(52) U.S. Cl.

CPC ..... *C25D 21/06* (2013.01); *C25D 3/02* (2013.01); *C25D 5/00* (2013.01); *C25D 5/003* (2013.01); *C25D 21/02* (2013.01); *C25D 21/18* (2013.01)

(58) Field of Classification Search

CPC ..... C25D 21/06

See application file for complete search history.

(56) References Cited

U.S. PATENT DOCUMENTS

| | | | | |
|---|---|---|---|---|
| 6,951,765 | B1 * | 10/2005 | Gopinath | C23C 18/1685 134/1.3 |
| 2003/0019756 | A1 * | 1/2003 | Yoshida | B23H 3/08 205/88 |
| 2007/0175763 | A1 * | 8/2007 | Nagai | C25D 5/003 205/88 |
| 2010/0000872 | A1 * | 1/2010 | Shimizu | C25D 15/02 205/98 |

OTHER PUBLICATIONS

Ke et al; "Electrodeposition of germanium from supercritical fluids" Phys. Chem. Chem. Phys., 2012, 14, p. 1517-1528. published Dec. 12, 2011.*

Nguyen, V. C. et al.; "The Relationship between Nano Crystalline Structure and Internal Stress in Ni Coatings Electrodeposited by Watts Bath Electrolyte Mixed with Supercritical CO2" Journal of the Electrochemical Society, D393-D399, 2012. published May 3, 2012.*

Shimizu et al, "Crystal growth on novel Cu electroplating using suspension of supercritical CO2 in elecreolyte with Cu particles" Surface & Coating Technology, 231, 2013, p. 77-80.*

(Continued)

*Primary Examiner* — Brian W Cohen

(74) *Attorney, Agent, or Firm* — Maschoff Brennan

(57) ABSTRACT

An electro-chemical plating process begins with supplying a supercritical fluid into an electroplating solution to be deposited, and a bias is applied between a substrate and an electrode, which is located in the electroplating solution. The substrate is placed into the electroplating solution to deposit a material on the substrate.

17 Claims, 5 Drawing Sheets

(56) References Cited

OTHER PUBLICATIONS

Bartlett, P.N. et al.; "Phase behaviour and conductivity study of electrolytes in supercritical hydrofluorocarbons" Phys. Chem. Chem. Phys., 2011, 13, 190-198. (Year: 2011).*

Shinoda, N. et al; "Cu electroplaing using suspension of supercritical carbon dioxide in copper-sulfate-based electrolyte with Cu particles" Thin Solid Films, 529 (2013), 29-33, (Year: 2013).*

* cited by examiner

APPARATUS AND PROCESS OF ELECTRO-CHEMICAL PLATING

BACKGROUND

The semiconductor integrated circuit (IC) industry has experienced rapid growth. Over the course of the growth, functional density of the semiconductor devices has increased with the decrease of device feature size or geometry. The scaling down process generally provides benefits by increasing production efficiency, reducing costs, and/or improving device performance, but on the other hand increases complexity of the IC manufacturing processes.

In the IC manufacturing processes, deposition processes are widely used on varying surface topologies in both front-end-of-the-line (FEOL) and back-end-of-the-line (BEOL) process. In FEOL process, deposition processes may be used to form polysilicon material on a substantially flat substrate, and deposition processes may be used to form metal interconnect layers within a cavity in a dielectric layer in BEOL processing. However, problems exist from the quality of the deposited material, and further improvements to the deposition processes are constantly necessary to satisfy the performance requirement in the scaling down process.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
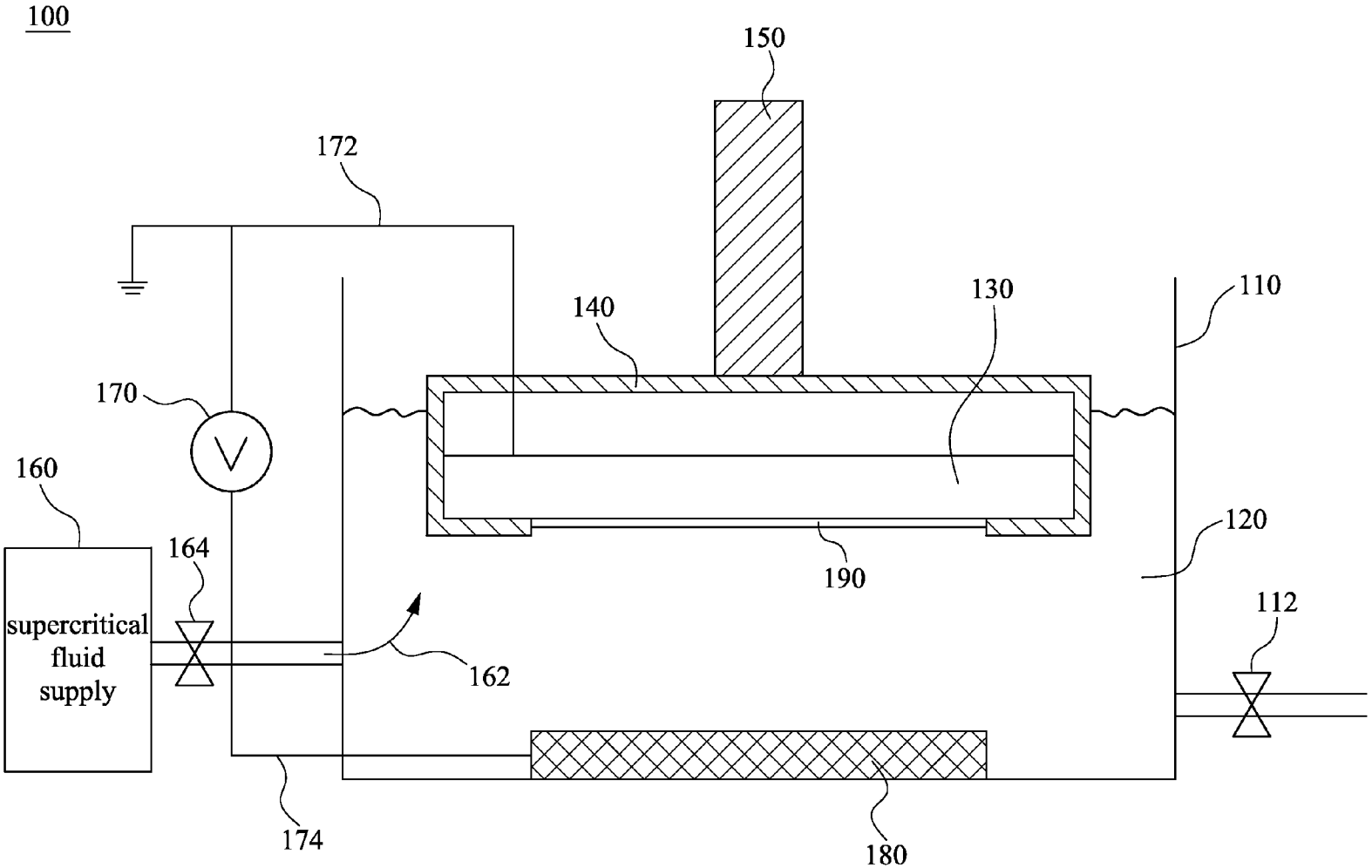
FIG. 1 is an electro-chemical plating (ECP) apparatus, in accordance with various embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Generally, different deposition processes may be used during fabrication of an integrated chip. The different deposition processes may include physical vapor deposition (PVD) processes, atomic layer deposition (ALD) processes, and electro-chemical plating (ECP) processes. However, each of these deposition processes has drawbacks limiting usefulness during semiconductor processing. For example, PVD processes deposit thin films having poor coverage. Conversely, ALD processes use complicated deposition chemistries to deposit films having good coverage, but which provide for a low throughput. Besides, precursor gases including high carbon content are necessary in ALD processes and increase a resistance of deposited metals.

Electro-chemical plating (ECP) processes deposit a layer of material onto a substrate by electrolytic deposition, which a substrate is submerged into an electroplating solution comprising ions of a material to be deposited. A DC voltage is applied to the substrate to attract ions from the electroplating solution to the substrate, and the ions condense on the substrate to form a thin film. First, the substrate is tilted an angle with a surface of the electroplating solution to submerge the substrate into the electroplating solution, and then the substrate is placed parallel in the electroplating solution. Therefore, bubbles will not form on the interface between the electroplating solution and the substrate to avoid defects formed on the substrate.

While tilting and submerging the substrate into the electroplating solution, the periphery of the substrate will suddenly suffer high entry voltage and high peak current, and thus forming defects on the periphery of the substrate. Besides, it has been appreciated that the DC voltage provides for a high deposition rate causing trench fill problems (e.g., forms voids) for high aspect ratios present in advanced technology nodes (e.g., in 32 nm, 22 nm, 16 nm, etc.). Further, gases are formed from the electroplating solution during the ECP process and causing pits or pinholes on the substrate.

The present disclosure provides an electro-chemical plating (ECP) process to reduce defects, pits and pinholes formed on the substrate, and also enhances the capability of trench filling. Please refer to FIG. 1 to further clarify the present disclosure. FIG. 1 is an electro-chemical plating (ECP) apparatus, in accordance with various embodiments. Although the present disclosure is described using a simplified ECP apparatus, those skilled in the art will appreciate that other ECP apparatus are equally suitable to achieve the desired processing results.

FIG. 1 illustrates an ECP apparatus, in accordance with various embodiments. The ECP apparatus 100 includes a container 110 configured to hold an electroplating solution 120, which includes a plurality of ions of a material to be deposited. In some embodiments, the electroplating solution 120 includes water, copper sulfate (CuSO4) and hydrochloric acid (HCl), which copper sulfate dissociates into cupric ($Cu^{2+}$) ions and $SO_4^{2-}$ ions in water. A substrate 130 is clipped by a substrate holder 140 and placed into the electroplating solution 120, which the substrate holder 140 is mounted on a rotatable spindle 150 to improve deposition on the substrate 130.

In some embodiments, the substrate 130 may be a substrate having a surface topology with one or more cavities or trenches. The substrate 130 may be a bulk silicon substrate. Alternatively, the substrate 130 may include an elementary semiconductor including silicon or germanium in crystal, polycrystalline, and/or an amorphous structure; a compound semiconductor including silicon carbide, gallium arsenic, gallium phosphide, indium phosphide, indium arsenide, and/or indium antimonide; an alloy semiconductor including SiGe, GaAsP, AlInAs, AlGaAs, GaInAs, GaInP, and/or GaInAsP; any other suitable material; and/or combinations thereof.

In embodiments, the substrate 130 is a silicon-on-insulator (SOI) substrate. The SOI substrate is fabricated using separation by implantation of oxygen (SIMOX), wafer bonding, and/or other suitable methods, and an exemplary insulator layer may be a buried oxide layer (BOX).

In various embodiments, the electroplating solution 120 further includes organic additives, for example, levelers, such as thiourea, benzotriazole (BTA) or Janus Green B (JGB), accelerators, such as bis(sodiumsulfopropyl)disulfide (SPS), and suppressors, such as polyethylene glycol (PEG) or polypropylene glycol (PPG).

A supercritical fluid supply 160 is configured to supply a supercritical fluid 162 into the electroplating solution 120, and the supercritical fluid 162 and the electroplating solution 120 are mixed in the container 110. The supercritical fluid 162 is a substance at a temperature and pressure above its critical point, where distinct liquid and gas phases do not exist. In addition, there is no surface tension in the supercritical fluid 162, as there is no liquid/gas phase boundary. The substrate 120 could be submerged into the electroplating solution 120 in substantially parallel to a surface of the electroplating solution 120, and the bubbles formed at the interface between the substrate 130 and the electroplating solution 120 are soluble in the supercritical fluid 162. Therefore, the periphery of the substrate 130 will not suffer high entry voltage and high peak current, and thus reduces defects on the substrate 130 after the ECP process. The supercritical fluid supply 160 further includes a first valve 164 configured to control a flow flux of the supercritical fluid 162 into the electroplating solution 120, and the container 110 further includes a second valve 112 configured to allow the mixture of the electroplating solution 120 and the supercritical fluid 162 flowing to the subsequent process.

In embodiments, the substance is selected from the group consisting of carbon dioxide ($CO_2$), xenon (Xe), argon (Ar), helium (He), krypton (Kr), nitrogen ($N_2$), methane ($CH_4$), ethane ($C_2H_6$), propane ($C_3H_8$), pentane ($C_5H_{12}$), ethylene ($C_2H_4$), methanol ($CH_3OH$), ethanol ($C_2H_5OH$), isopropanol ($C_3H_7OH$), isobutanol ($C_4H_9OH$), cyclohexanol ($(CH_2)_5CHOH$), ammonia ($NH_3$), nitrous oxide ($N_2O$), oxygen ($O_2$), silicon hexafluoride ($SiF_6$), methyl fluoride ($CH_3F$), chlorotrifluoromethane ($CClF_3$) and water ($H_2O$). In various embodiments, the substance may be in liquid state or in gas state at the room temperature and pressure.

In embodiments, the substance does not react with the electroplating solution 120, and the critical temperature and the critical pressure of the substance will not affect the ECP process.

In embodiments, the supercritical fluid is carbon dioxide achieving at a temperature greater than about 31° C. and at a pressure greater than about 73 atmospheres. In supercritical fluid state, carbon dioxide is an inert solvent with a liquid-like density, a gas-like diffusivity and viscosity, and an effective surface tension of near to zero.

In embodiments, the container 110 should be maintained at a temperature above a critical temperature of the substance and at a pressure above a critical pressure of the substance, to assure the substance is maintained in supercritical liquid state.

The ECP apparatus also includes a power supply 170, such as a DC power supply. The power supply 170 is electrically connected to the substrate 130 through one or more slip rings, brushes, or contact pins (not shown). Thus, a negative output lead 172 of the power supply 170 is electrically connected to the substrate 130 via substrate holder 140 or more directly connected. A positive output lead 174 of the power supply 170 is electrically connected to an electrode 180 located in the electroplating solution 120, which the electrode 180 is separated from the substrate 130. During ECP process, the power supply 170 provides a bias between the substrate 130 and the electrode 180, which the substrate 130 acts as a cathode, the electrode 180 acts as an anode, and an electrical current is from the electrode 180 to the substrate 130. Electrical current flows in the same direction as the net positive ion flux and opposite to the net electron flux. More specifically, the bias promotes diffusion of the ions of the material toward the substrate 130, and the ions are reduced to form the material 190 on the substrate 130. In embodiments, an electrochemical reaction (e.g., $Cu^{2+}+2e^{-}=Cu$) is occurred on the substrate 130 to form a metal layer (e.g., copper) thereon.

During the ECP process, the material 190 is deposited on the substrate 130 accompanied with a gas reduction reaction (e.g., $2H^{+}+2e^{-}=H_2$), which generates gases at the interface between the substrate 130 and the electroplating solution 120. These gases may migrate to the surface of the substrate 130 and affect the integrality of the material 190. As aforementioned, the electroplating solution 120 is mixed with the supercritical fluid 162. Because there is no liquid/gas phase boundary in the supercritical fluid 162, these gases will dissolve in the supercritical fluid 162 supplied by the supercritical fluid supply 160, and thus reducing pits or pinholes formed on the material 190.

Figure 2B:
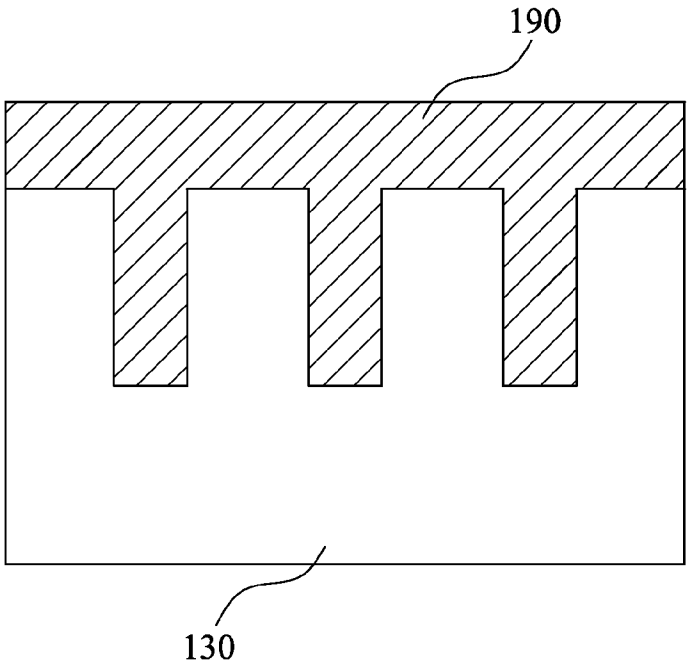
FIG. 2B is a cross-sectional view of the substrate after the ECP process, in accordance with various embodiments.
Figure 2A:
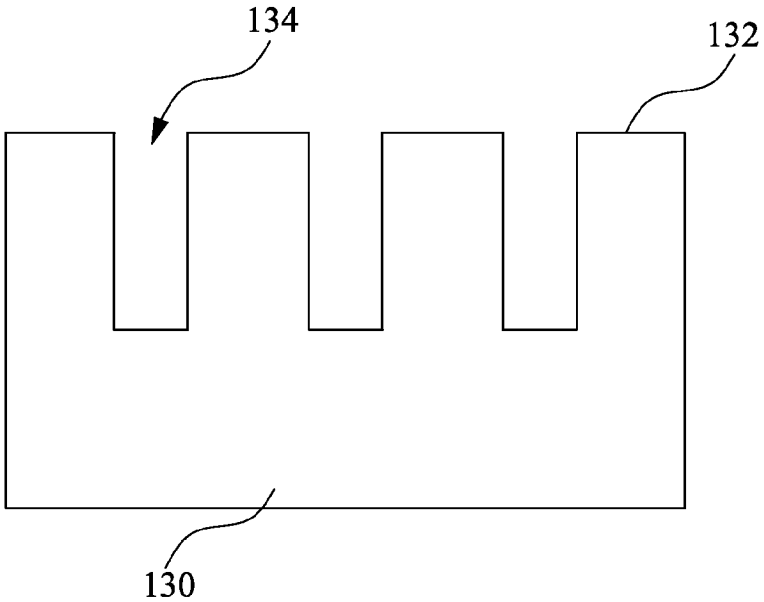
FIG. 2A is a cross-sectional view of the substrate before the ECP process, in accordance with various embodiments.

Besides, it is believed that the supercritical fluid 162 could enhance the capability of the ECP process for trench filling. Please refer to FIGS. 2A and 2B to further clarify the present disclosure. FIG. 2A is a cross-sectional view of the substrate before the ECP process, in accordance with various embodiments, and FIG. 2B is a cross-sectional view of the substrate after the ECP process, in accordance with various embodiments. As shown in FIG. 2A, the substrate 130 includes a plurality of trenches 134 extending from a top surface 132 of the substrate 130 into the substrate 130. The trenches 134 may be formed in the substrate 130 using suitable processes including photolithography and etch processes. The photolithography process may include forming a photoresist layer (not shown) overlying the substrate 130, exposing the photoresist layer to form a pattern, performing post-exposure bake processes, and developing the pattern to form a masking element. The masking element mentioned above is used to protect portions of the substrate 130 while forming trenches in the substrate 130 by the etching process.

In embodiments, the trench 134 has a depth in a range from about 100 nm to about 400 nm. In various embodiments, the trench 134 has a width in a range from about 50 nm to about 100 nm.

Continuing in FIG. 2B, the material 190 is formed on the substrate 130 and fully filling the trenches 134. Since the width of the trench 134 has decreased with increase of functional density of the semiconductor devices on the substrate 130, and thus the difficulty of filling the trenches 134 has increased. To avoid voids remained in the substrate 130, the supercritical fluid 162 is supplied to enhance the capability of trenches filling during the ECP process.

In the ECP process, a thickness of a boundary layer is calculated by the following formula:

$$L = \frac{Re \times Mu}{V \times \rho}$$

L is the thickness of the boundary layer; Re is Reynolds number of the electroplating solution 120; Mu is a viscosity of the electroplating solution 120; V is a velocity of the electroplating solution 120; and ρ is a density of the electroplating solution 120. As shown in the formula, the thickness of the boundary layer will be changed with the viscosity and the velocity of the electroplating solution 120. It is believed that reducing the thickness of the boundary layer increases the wetting ability of the electroplating solution 120. Therefore, the supercritical fluid 162 is supplied into the electroplating solution 120 on the purpose to reduce the thickness of the boundary layer. Since the supercritical fluid 162 has diffusivity of the gas, which increases the velocity of electroplating solution 120. Besides, the supercritical fluid 162 has lower viscosity than the electroplating solution 120. Therefore, supplying the supercritical fluid 162 into the electroplating solution 120 will decrease the thickness of the boundary layer formed by the electroplating solution 120, and the trenches 134 are better wetted to assist the ECP process for filling the material 190. After biasing the substrate 130, the material 190 is formed on the substrate 130 and filling the trenches 134, to avoid voids remained in the substrate 130.

Figure 3:
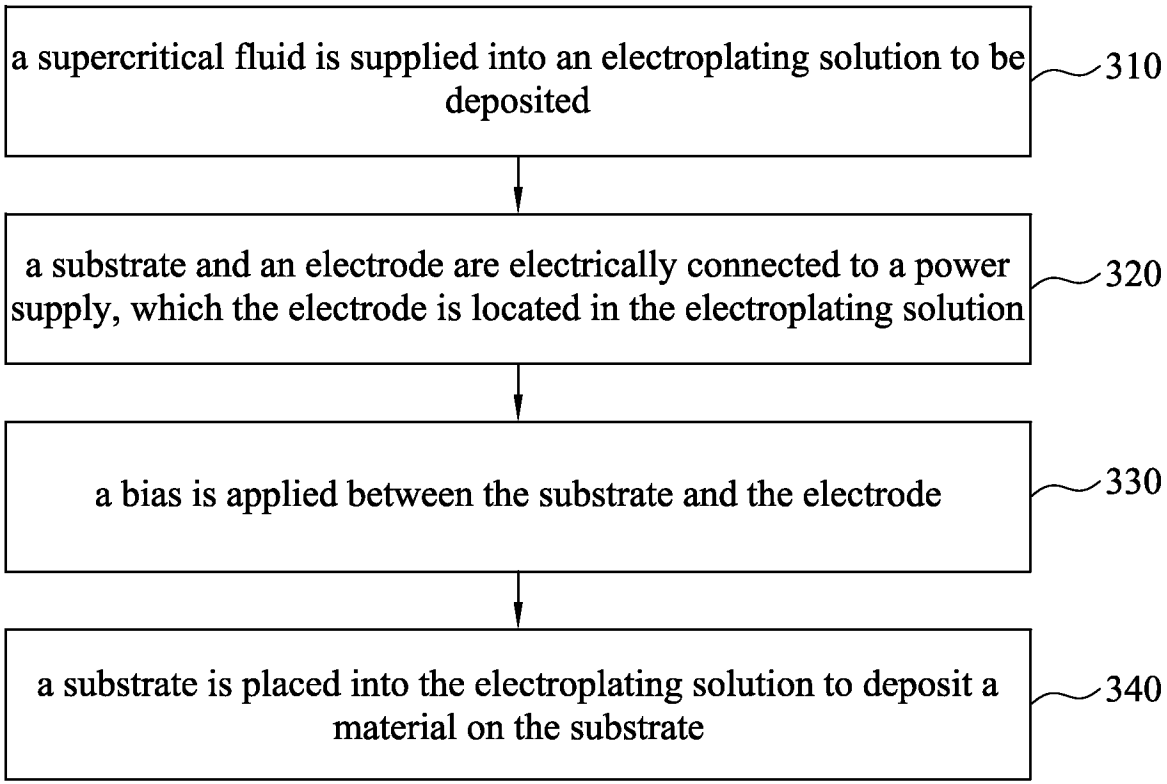
FIG. 3 is a diagram of an electro-chemical plating (ECP) process, in accordance with various embodiments.

FIG. 3 is a diagram of an electro-chemical plating (ECP) process, in accordance with various embodiments. The ECP process is undergoing in the ECP apparatus shown in FIG. 1, please refer to FIG. 1 at the same time. While the disclosed process is illustrated and described below as a series of operations, it will be appreciated that the illustrated ordering of such operations are not to be interpreted in a limiting sense. For example, some operations may occur in different orders and/or concurrently with other operations apart from those illustrated and/or described herein. In addition, not all illustrated operations may be required to implement one or more aspects or embodiments of the description herein. Further, one or more of the operations depicted herein may be carried out in one or more separate operations.

The ECP process begins with operation 310, a supercritical fluid is supplied into an electroplating solution to be deposited. Please refer to FIG. 1, the supercritical fluid supply 160 supplies the supercritical fluid 162 into the electroplating solution 120, and the electroplating solution 120 includes a plurality of ions of the material. In some embodiments, the electroplating solution 120 includes water, copper sulfate (CuSO4) and hydrochloric acid (HCl), which copper sulfate dissociates into cupric ($Cu^{2+}$) ions and $SO_4^{2-}$ ions in water.

The supercritical fluid 162 is a substance at a temperature and pressure above its critical point. In various embodiments, substance is selected from the group consisting of carbon dioxide ($CO_2$), xenon (Xe), argon (Ar), helium (He), krypton (Kr), nitrogen ($N_2$), methane ($CH_4$), ethane ($C_2H_6$), propane ($C_3H_8$), pentane ($C_5H_{12}$), ethylene ($C_2H_4$), methanol ($CH_3OH$), ethanol ($C_2H_5OH$), isopropanol ($C_3H_7OH$), isobutanol ($C_4H_9OH$), cyclohexanol ($(CH_2)_5CHOH$), ammonia ($NH_3$), nitrous oxide ($N_2O$), oxygen ($O_2$), silicon hexafluoride ($SiF_6$), methyl fluoride ($CH_3F$), chlorotrifluoromethane ($CClF_3$) and water ($H_2O$). In various embodiments, the substance may be in liquid state or in gas state at the room temperature and the room pressure.

In embodiments, the supercritical fluid 162 is carbon dioxide achieving at a temperature greater than about 31° C. and at a pressure greater than about 73 atmospheres. In supercritical fluid state, carbon dioxide is an inert solvent with a liquid-like density, a gas-like diffusivity and viscosity, and an effective surface tension of near to zero.

In various embodiments, the impurities in the supercritical fluid 162 are filtered before supplying the supercritical fluid 162 into the electroplating solution 120.

Referring to operation 320, a substrate and an electrode are electrically connected to a power supply, which the electrode is located in the electroplating solution. Please refer to FIG. 1, the negative output lead 172 of the power supply 170 is electrically connected to the substrate 130, and the positive output lead 174 is electrically connected to the electrode 180, which is at the bottom of the electroplating solution 120. In embodiments, the substrate 130 is electrically connected to the power supply 170 directly. In some embodiments, the substrate 130 is electrically connected to the power supply 170 via the substrate holder 140.

Continuing to operation 330, a bias is applied between the substrate and the electrode. Please refer to FIG. 1, the substrate 130 is electrically connected to the negative output lead 172 of the power supply 170 and acts as a cathode, and the electrode 180 acts as an anode.

Continuing in operation 340, the substrate is placed into the electroplating solution to deposit a material on the substrate. Please refer to FIG. 1, the substrate holder 140 clips the substrate 130 to submerge the substrate 130 into the electroplating solution 120. The power supply 170 provides a bias between the cathode and the anode, and the bias promotes diffusion of the ions of the material towards the substrate 130, which the ions are reduced to form the material 190 on the substrate 130. With supplying the supercritical fluid 162, the substrate 130 could be placed into the electroplating solution 120 substantially in parallel to a surface of the electroplating solution 120, without forming the bubbles at the interface between the substrate 130 and the electroplating solution 120. Therefore, the periphery of the substrate 130 will not suffer high entry voltage and high peak current, and thus reduces defects on the substrate 130 after the ECP process.

In embodiments, the substrate 130 includes a plurality of trenches, and the substrate 130 is rotated by the rotatable spindle 150 to increase trench filling capability of the ECP process.

Figure 4:
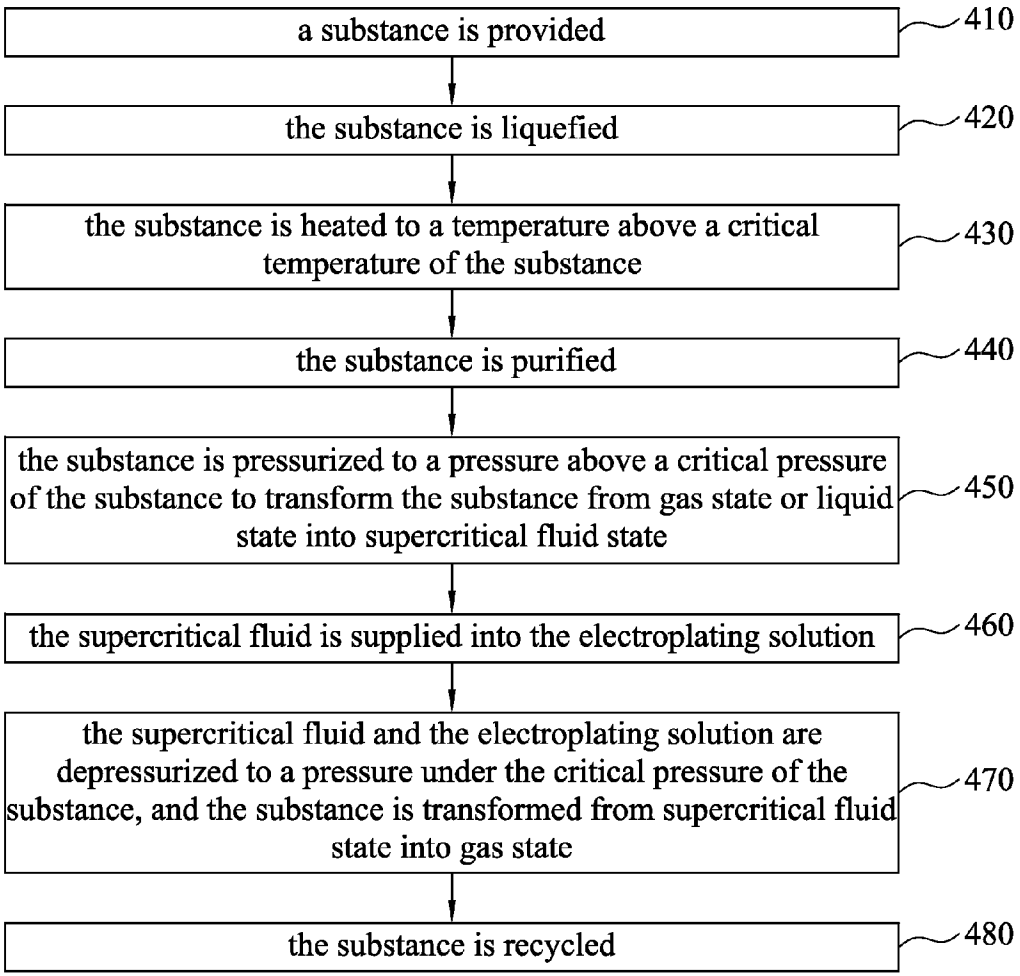
FIG. 4 is a diagram of a method for preparing and recycling the supercritical fluid, in accordance with various embodiments.
Figure 5:
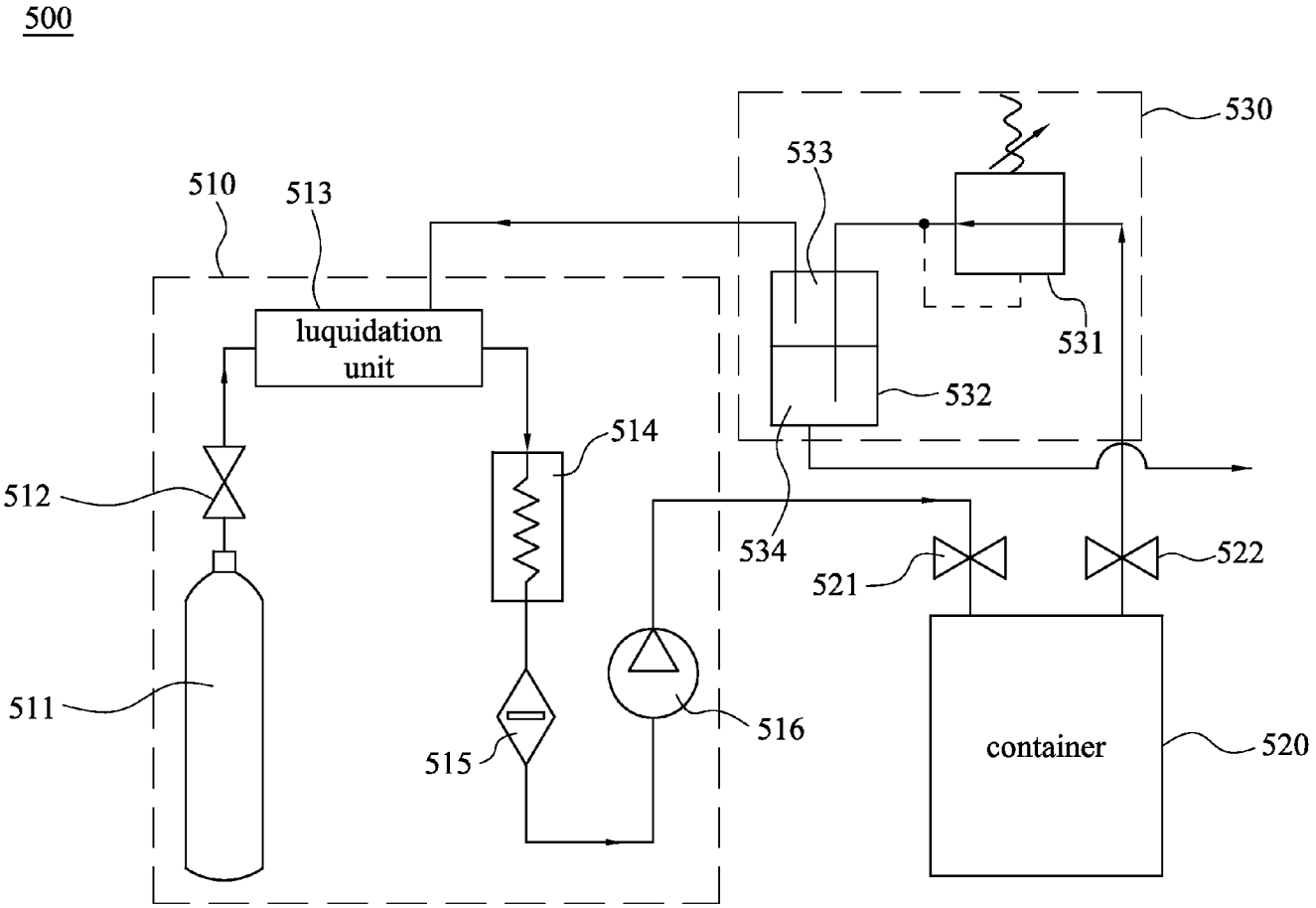
FIG. 5 is an electro-chemical plating (ECP) apparatus, in accordance with various embodiments.

Please refer to FIG. 4 and FIG. 5 to further clarify the present disclosure. FIG. 4 is a diagram of a method for preparing and recycling the supercritical fluid, in accordance with various embodiments, and FIG. 5 is an electro-chemical plating (ECP) apparatus, in accordance with various embodiments. As shown in FIG. 4, the method begins with operation 410, a substance is provided. Please refer to FIG. 5 at the same time, an ECP apparatus 500 includes a supercritical fluid supply 510, a container 520 and a supercritical fluid recycling device 530. The substance is stored in a tank 511 of the supercritical fluid supply 510. In embodiments, the substance is in gas state and stored in a gas cylinder. In various embodiments, the substance is in liquid phase and stored in a liquid storage tank.

In embodiments, the substance is selected from the group consisting of carbon dioxide ($CO_2$), xenon (Xe), argon (Ar), helium (He), krypton (Kr), nitrogen ($N_2$), methane ($CH_4$), ethane ($C_2H_6$), propane ($C_3H_8$), pentane ($C_5H_{12}$), ethylene ($C_2H_4$), methanol ($CH_3OH$), ethanol ($C_2H_5OH$), isopropanol ($C_3H_7OH$), isobutanol ($C_4H_9OH$), cyclohexanol ($(CH_2)_5CHOH$), ammonia ($NH_3$), nitrous oxide ($N_2O$), oxygen ($O_2$), silicon hexafluoride ($SiF_6$), methyl fluoride ($CH_3F$), chlorotrifluoromethane ($CClF_3$) and water ($H_2O$).

Continuing to operation 420, the substance is liquefied. On the purpose to reduce transport difficulties and enhance efficiency of the process, the substance in gas state is liquefied first. Please referring to FIG. 5 at the same time, a first valve 512 is opened to allow the substance entering a liquidation unit 513, which provides high pressure for liquefying the substance in gas state. In embodiments, it is not necessary to liquefy the substance in liquid state.

Referring to operation 430, the substance is heated to a temperature above a critical temperature of the substance. Please referring to FIG. 5 at the same time, the substance flows through a heater 514, which is configured to heat the liquefied substance to a temperature above a critical temperature of the substance. In embodiments, the heater 514 may heat the substance to a temperature equal the critical temperature of the substance.

Continuing in operation 440, the substance is purified. Because impurities in the substance will influence the yield of the products, these impurities should be removed to assure the cleanness of the substance. Please referring to FIG. 5 at the same time, the substance flows through a filter 515, which is configured to remove impurities in the substance. In embodiments, the filter 460 may include activated carbon or aluminium oxide.

Referring to operation 450, the substance is pressurized to a pressure above a critical pressure of the substance to transform the substance from gas state or liquid state into supercritical fluid state. Please referring to FIG. 5 at the same time, the substance flows through a pressure pump 516, which is configured to pressurize the substance to a pressure above a critical pressure of the substance. In embodiments, the pressure pump 516 may pressurize the substance to a pressure equal the critical pressure of the substance. After pressurize and heating the substance, the phase boundary between the gas phase and liquid phase disappears, and the substance is transformed into supercritical fluid phase. In the supercritical fluid phase, the substance assumes some of the properties of a gas and some of the properties of a liquid. For example, supercritical fluids have diffusivity properties similar to gases but solvating properties similar to liquids.

In embodiments, the substance may flow through the filter 515 before transforming into supercritical fluid state. For example, the substance flows through the filter 515 before the heater 514 and the pressure pump 516, or the substance flows through the filter 515 before the heater 514 but after the pressure pump 516. In embodiments, the substance may flow through the filter 515 in supercritical fluid state.

Referring to operation 460, the supercritical fluid is supplied into the electroplating solution. Please referring to FIG. 5 at the same time, a second valve 521 is opened to allow the supercritical fluid flowing into the container 520. In the container 520, the supercritical fluid is mixed with the electroplating solution, and a substrate is electroplated. The substrate is placed into the electroplating solution substantially in parallel to a surface of the electroplating solution and electrically connected to a power supply, which the substrate acts as a cathode. An electrode is positioned at a bottom of the electroplating solution and separated from the substrate, which the electrode is also electrically connected to a power supply and acts as an anode. The power supply provides a bias between the cathode and the anode, and a material is formed on the substrate and filling the trenches in the substrate.

After the ECP process, the substance is recycled from the electroplating solution. Continuing in operation 470, the supercritical fluid and the electroplating solution are depressurized to a pressure under the critical pressure of the substance, and the substance is transformed from supercritical fluid state into gas state. Please referring to FIG. 5 at the same time, a third valve 522 is opened to allow the mixture of the supercritical fluid and the electroplating solution flowing through a relief valve 531 of the recycling device 530. The relief valve 531 is configured to depressurize supercritical fluid and the electroplating solution to a pressure under the critical pressure of the substance, and the substance will transform from supercritical fluid state into gas state.

Continuing in operation 480, the substance is recycled. Please referring to FIG. 5 at the same time, the substance returns to gas state after depressurizing, which the substance and the electroplating solution are introduced to a gas trap 532 of the recycling device 530. The gas trap 532 is configured to separate the substance in gas state and the electroplating solution in liquid state. More specifically, gas-liquid separation is occurred in the gas trap 532, which includes an upper layer 533 and a bottom layer 534. The upper layer 533 includes the substance in gas state, and the bottom layer 534 includes the electroplating solution in liquid state. Therefore, the substance in the upper layer 533 could be retrieved and recycled for other processes.

In embodiments, the recycled substance is applied to produce the supercritical fluid. The usage of the substance in the ECP process is reduced, and thus the productivity is improved. In various embodiments, the recycled substance may be applied to produce the supercritical fluid for substrate cleaning.

The embodiments of the present disclosure discussed above have advantages over existing apparatus and processes, and the advantages are summarized below. The present disclosure introduces supercritical liquid to the electroplating solution to enhance the efficiency of the ECP process. First, the substrate is placed into the electroplating solution substantially in parallel to a surface of the electroplating solution, and the bubbles formed between the interface of the substrate and the electroplating solution are dissolved in the supercritical liquid. Therefore, the periphery of the substrate avoids suffering high entry voltage and high peak current. Besides, the gases ($H_2$) formed during the ECP process are also dissolved in the supercritical liquid.

Second, the supercritical fluid enhances the trench filling capability of the ECP process. The supercritical fluid increases the wetting ability of the electroplating solution to assist reaction in small trenches, and thus reduces voids in the substrate after the ECP process. On the other hand, the present disclosure also discloses a recycling device configured to recycle the substance from the electroplating solution. After the ECP process, the substance is returned to gas state and being recycled for preparing the supercritical fluid again. Therefore, the substance usage and the processing time are reduced to decrease costs of the ECP process. Summarize above points, the supercritical liquid decreases defects and voids formed on/in the substrate, and the substance is recyclable to regenerate the supercritical liquid. The efficiency and yield of the ECP process could be enhanced significantly.

In accordance with some embodiments, the present disclosure discloses an electro-chemical plating (ECP) process. The ECP process begins with supplying a supercritical fluid into an electroplating solution to be deposited, and a bias is applied between a substrate and an electrode, which is located in the electroplating solution. The substrate is placed into the electroplating solution to deposit a material on the substrate.

In accordance with various embodiments, the present disclosure discloses an electro-chemical plating (ECP) process. The ECP process begins with preparing a supercritical fluid from a substance, and the supercritical fluid is supplied into an electroplating solution. A substrate is placed into the electroplating solution and being electroplated. After electroplating the substrate, the substance is recycled from the electroplating solution.

In accordance with various embodiments, the present disclosure discloses an electro-chemical plating (ECP) apparatus. The ECP apparatus includes a container having a substrate and an electrode in an electroplating solution, which the electrode is separated from the substrate. A power supply is configured to provide a bias between the substrate and the electrode, and a supercritical fluid supply is configured to supply a supercritical fluid into the container.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An electro-chemical plating (ECP) process, comprising:

filtering a substance in a liquid state to remove impurities in the substance;

pressurizing and heating the substance to form a supercritical fluid;

supplying the supercritical fluid into an electroplating solution;

applying a bias between a substrate and an electrode, wherein the electrode is located in the electroplating solution; and placing the substrate into the electroplating solution with the supercritical fluid to deposit a material on the substrate.

2. The ECP process of claim 1, wherein the electroplating solution comprises a plurality of ions of the material.

3. The ECP process of claim 2, wherein the bias promotes diffusion of the ions of the material towards the substrate, and the ions are reduced to form the material on the substrate.

4. The ECP process of claim 1, wherein the substrate acts as a cathode, and the electrode acts as an anode during applying the bias between the substrate and the electrode.

5. The ECP process of claim 1, wherein the substrate is placed into the electroplating solution substantially parallel to a surface of the electroplating solution.

6. The ECP process of claim 1, wherein the supercritical fluid is a substance at a temperature and pressure above a critical point of the substance.

7. The ECP process of claim 6, wherein the substance is selected from the group consisting of carbon dioxide, xenon, argon, helium, krypton, nitrogen, methane, ethane, propane, pentane, ethylene, methanol, ethanol, isopropanol, isobutanol, cyclohexanol, ammonia, nitrous oxide, oxygen, silicon hexafluoride, methyl fluoride, chlorotrifluoromethane, and water.

8. The ECP process of claim 1, wherein the pressurizing and heating the substance to form the supercritical fluid comprises:

heating the substance to a temperature above a critical temperature of the substance; and pressurizing the substance to a pressure above a critical pressure of the substance to transform the substance from the liquid state into a supercritical fluid state to form the supercritical fluid.

9. An electro-chemical plating (ECP) process, comprising:

providing a substance in a liquid state filtering impurities in the substance;

after filtering the impurities in the substance, transforming the substance to a supercritical fluid;

mixing the supercritical fluid and an electroplating solution to form a mixture;

submerging a substrate into the mixture; and electroplating the substrate to deposit a material on a surface of the substrate.

10. The ECP process of claim 9, wherein the mixture comprises a plurality of ions of the material.

11. The ECP process of claim 9, wherein the surface of the substrate is substantially parallel to an upper surface of the mixture when submerging the substrate into the mixture.

12. The ECP process of claim 9, wherein the supercritical fluid is a substance at a temperature and a pressure above a critical point of the substance.

13. The ECP process of claim 12, wherein the substance is selected from the group consisting of carbon dioxide, xenon, argon, helium, krypton, nitrogen, methane, ethane, propane, pentane, ethylene, methanol, ethanol, isopropanol, isobutanol, cyclohexanol, ammonia, nitrous oxide, oxygen, silicon hexafluoride, methyl fluoride, chlorotrifluoromethane, and water.

14. The ECP process of claim 9, wherein the impurities are filtered with a filter, and the filter comprises activated carbon or aluminium oxide.

15. The ECP process of claim 9, wherein transforming the substance to the supercritical fluid comprises:

heating the substance to a temperature above a critical temperature of the substance; and pressurizing the substance to a pressure above a critical pressure of the substance to transform the substance from the liquid state into a supercritical fluid state to form the supercritical fluid.

16. The ECP process of claim 9, wherein electroplating the substrate comprises:

providing an electrode in the mixture; and providing a bias between the substrate and the electrode with a power supply electrically connected with the electrode and the substrate to form the material.

17. An electro-chemical plating (ECP) process, comprising:

when a substance is in a liquid state, filtering impurities in the substance;

after filtering the impurities, heating and pressurizing the substance to form a supercritical fluid;

supplying the supercritical fluid into an electroplating solution to form a mixture; and electroplating a substrate using the mixture.

* * * * *